United States Patent [19]

Burgdorf et al.

[11] Patent Number: 4,505,652

[45] Date of Patent: Mar. 19, 1985

[54] SPHERICAL PISTON PUMP

[75] Inventors: Jochen Burgdorf, Offenbach; Ludwig Budecker, Frankfurt, both of Fed. Rep. of Germany

[73] Assignee: ITT Industries, Inc., New York, N.Y.

[21] Appl. No.: 394,370

[22] Filed: Jul. 1, 1982

[30] Foreign Application Priority Data

Oct. 5, 1981 [DE] Fed. Rep. of Germany ..... 3139561

[51] Int. Cl.[3] ..... F04B 19/02; F01B 13/04

[52] U.S. Cl. ..... 417/462; 91/498; 92/248

[58] Field of Search ..... 417/462; 91/491, 492, 91/498; 92/177, 248; 418/225

[56] References Cited

U.S. PATENT DOCUMENTS

| | | | |
|---|---|---|---|
| 459,735 | 9/1891 | Benham | 91/498 |
| 2,251,259 | 8/1941 | Carmichael | 92/178 |
| 2,855,858 | 10/1958 | Larsen et al. | 417/462 |
| 2,972,311 | 2/1961 | Baugh et al. | 91/498 |
| 3,084,633 | 4/1963 | Henrichsen | 91/498 |
| 3,664,772 | 5/1972 | Panariti | 91/491 |
| 3,955,476 | 5/1976 | David et al. | 91/491 |
| 4,043,255 | 8/1977 | Cunningham | 92/248 |

FOREIGN PATENT DOCUMENTS

| | | | |
|---|---|---|---|
| 579539 | 7/1958 | Italy | 91/498 |

*Primary Examiner*—William L. Freeh
*Assistant Examiner*—Paul F. Neils
*Attorney, Agent, or Firm*—James B. Raden; Edward J. Brosius

[57] ABSTRACT

The spherical piston pump comprises an outer stator and an inner rotor rotatable on a control pintle provided with supply and discharge channels. The rotor contains at least one radial bore in which is slidable a spherical piston including an outer ball, a cylindrical sleeve and an inner ball. The outer ball, sleeve and inner ball are not fastened to one another and can be replaced independently of each other. Annular sliding members made of low-friction and sound-damping material can be integrated into the ends of the sleeve, each of the sliding members being in line contact with the associated one of the two balls. The construction provides good volumetric efficiency even at high pressure and an improved overall efficiency of the pump.

10 Claims, 3 Drawing Figures

SPHERICAL PISTON PUMP

BACKGROUND OF THE INVENTION

The present invention relates to a radial piston machine and more particularly to a spherical piston pump having at least one spherical piston whose ball is adapted to roll on an outer cam ring or stator and cooperates with a piston element which slides in a radial bore of a rotor rotatable on a stationary control pintle which is provided with supply and discharge channels.

A spherical piston pump having the construction referred to hereinabove is known from German Patent DE-OS No. 2,908,096. The slidable cylindrical sleeve disposed in a snug fit relative to the rotor's radial bore and including an inner axial passageway ensures a sealing by means of surfaces between rotor and sleeve and overlaps the ball in a manner so as to provide between the ball and the sleeve a sealing by means of surfaces. The arrangement is so made to establish a rigid connection between the ball and the sleeve after assembly and to allow as a consequence an eventual replacement of the entire unit only.

SUMMARY OF THE INVENTION

It is an object of the present invention to provide a spherical piston pump or radial piston machine having a simple construction and good efficiency.

A feature of the present invention is the provision of a spherical piston pump comprising an outer stator; an inner rotor rotatable on a control pintle having supply and discharge channels; at least one spherical piston including a first ball disposed to roll on a cam surface of a selected one of the stator and an outer cam ring; and a piston element slidable in a radial bore of the rotor; the first ball and the piston element being in a cooperative relationship with each other and the first ball has the periphery thereof slidably guided in the radial bore.

Favorably, the ball is a standard component of great manufacturing accuracy. A good gap seal will be attained on account of the ball fitting precisely in the bore. The sealing effect of the ball adds to the sealing effect of the piston element which results in a good volumetric efficiency. By using the ball, there results in a favorable manner a minor friction influence due to viscous friction. The ball and piston element are not fastened to one another and are, therefore, replaceable independently.

In an advantageous improvement of the present invention a second ball is provided in the piston element. Besides a minor friction influence due to viscous friction, a good sealing effect will be accomplished by the existence of two balls.

Expendiently, an intermediate member is interposed between the balls, both balls being operatively but not mechanically connected thereto. The behavior in operation can be influenced favorably by the intermediate member's construction and by selection of its material.

The intermediate member is advantageously formed as a sleeve whose ends close to the balls are of equal construction. As a result thereof the sleeve is stressed more evenly. Manufacture of the sleeve will be simplified owing to the end areas having like construction.

In a particularly expedient manner, the sleeve may be made up of two like single members so that a single sleeve member can also be employed as the intermediate member in the event of a cylindrical piston element which is not constructed as a ball.

In an advantageous improvement, the surfaces of the sleeve which abut on the balls are inclined. This enables influencing in a most simple manner the distribution of the forces acting on the spherical piston arrangement.

In a particularly favorable embodiment, the surface of the sleeve that abuts on the ball is a sliding surface made of a material having a low coefficient of friction. For instance, the sleeve may be made entirely of this material. In a most simple fashion, there will be ensured that the radially outward ball rolls on the cam ring, provided that the driving torque (friction at the cam ring) is greater than the brake torque (friction of the ball at the rotor bore and at the conical periphery of the sleeve). The occurrence of low friction enables the radially inward ball to easily perform compensating movements that may become necessary.

A particularly favorable arrangement will ensue if the sliding surface is formed by an annular sliding member which is integrated into the end of the sleeve.

Expendiently, the sliding member or the sleeve is formed from a sound-damping material.

Ease of manufacture and good operation of a spherical piston pump or radial piston machine will result, if the cross-section of the sliding member is a right-angled triangle whose hypotenuse is in engagement with the ball. The two legs of the right-angled triangle may be constructed equally long.

In an improvement of the present invention, the sleeve is made of a material having a coefficient of thermal expansion higher than that of the rotor material enclosing the sleeve. Since a corresponding fitting accuracy and the possibility of expansion for the sleeve is provided, a greater sealing effect will be ensured in the sealing by means of surfaces between sleeve and rotor at high operating temperatures and correspondingly low viscosity of the operating medium, and the efficiency will be increased.

In another improvement of the present invention, the cylindrical periphery of the sleeve will be arranged to extend over the entire axial length of the sleeve. Thus, the effect of sealing by means of surfaces or a gap between sleeve and rotor will be increased further.

The sealing by means of surfaces between sleeve and rotor will be improved if the outer diameter of the sleeve is substantially like the ball diameter.

Provision of the centric axial passageway and the radial bore causes the working pressure to prevail in the sleeve's interior between the inward and outward balls.

In an advantageous improvement, the balls are of like diameter. Since the balls are seated precisely in the radial bore, there will occur at each ball substantially the same loss in pressure so that each ball is loaded by half the working pressure only. The spherical piston is of straight-forward and low-cost construction when two standardized balls are used. For replacement purposes, it is required to hold in stock only one component, namely, the ball.

Because of the radially inward ball which forms the piston element, being arranged in the rotor bore with smaller clearance than the radially outward ball, there results at the radially inward ball a higher drop in pressure and, thus, a better sealing effect compared to the outward ball. Thereby, the radially inward ball mainly provides for the sealing, while the radially outward ball rolls on the rotor bore with less friction because of the larger clearance.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Figure 1:
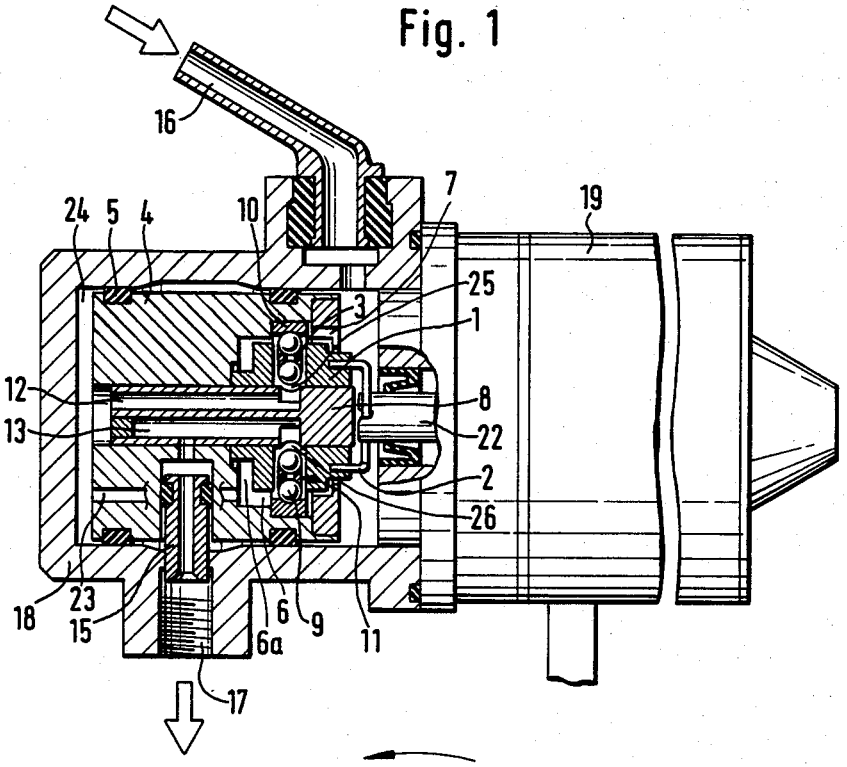
FIG. 1 is a longitudinal cross sectional view of a spherical piston pump in accordance with the principles of the present invention.
Figure 2:
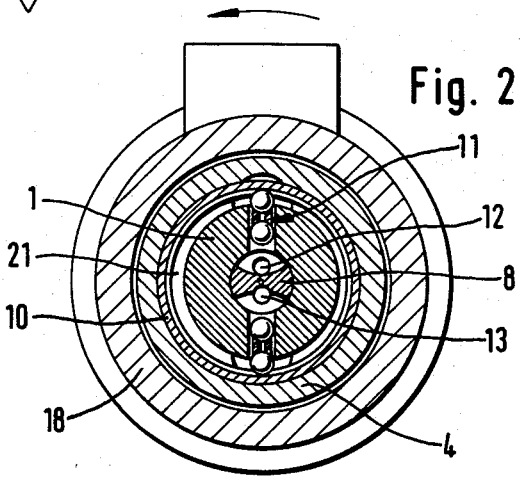
FIG. 2 is a transverse cross sectional view of the pump of FIG. 1 in the area of the axis of the spherical piston.

Referring to FIGS. 1 and 2, the spherical piston pump comprises a cup-type housing 18, closed on one end face, having a suction port 16 and a pressure port 17 on the housing periphery.

The interior of housing 18 accommodates a rotor-stator unit which is supported at housing 18 through elastic sealing supporting members 5 having the shape of O-rings, in order to enable the pump to operate at a low noise level. Beside elastic supporting members 5, the rotor-stator unit is held in a torsionally secured position relative to the housing 18 by an insert 15 inserted in pressure port 17 between housing 18 and stator 4. No metallic contact takes place between insert 15 and stator 4 because there are interposed therebetween further elastic supporting members having a sealing effect.

The rotor-stator unit comprises an outer stator 4 and an inner rotor 1 rotatably seated on one end (the right end as seen in FIG. 1) of a central control pintle 8, control pintle 8 being received in an internal bore of stator 4 and possessing a supply channel 12 as well as a discharge channel 13, respectively, from the rotor interior.

One end wall of rotor 1 is connected to one end of a shaft 22 of an electric motor 19 via an axially and torsionally elastic spring clutch 2, shaft 22 being disposed in a coaxial extension of the rotor 1.

The interior of rotor 1 contains a radial throughbore having therein diametrically opposite, radially displaceable spherical pistons 11 whose outer balls 9 roll on an eccentric cam ring 10 which is supported axially slidably on stator 4.

When the spherical piston pump is operated, rotation of rotor 1 causes hydraulic fluid to be drawn in through suction port 16 on the suction side 7 of the pump, which fluid is pressurized in the circumferential chamber 21 as shown in FIG. 2 and fed from the pressure side compartment 6 of the pump via a longitudinal bore 23 of stator 4, a compartment 24 and supply channel 12 to the suction chamber on the radially inner side of spherical piston 11 and, after another half rotation of rotor 1, is discharged via the pressure chamber 26, discharge channel 13 of control pintle 8 and pressure port 17 of the pump. In this arrangement, centrifugal force and the working pressure urge spherical pistons 11 outwardly against cam ring 10. With the pump in operation, rotor 1 will be urged in an axial direction against spring clutch 2 of shaft 22 by the pump pressure generated in the compartments 6 and 6*a*, while the rotor-stator unit is retained in an axially centered position clear of contact relative to housing 18.

Figure 3:
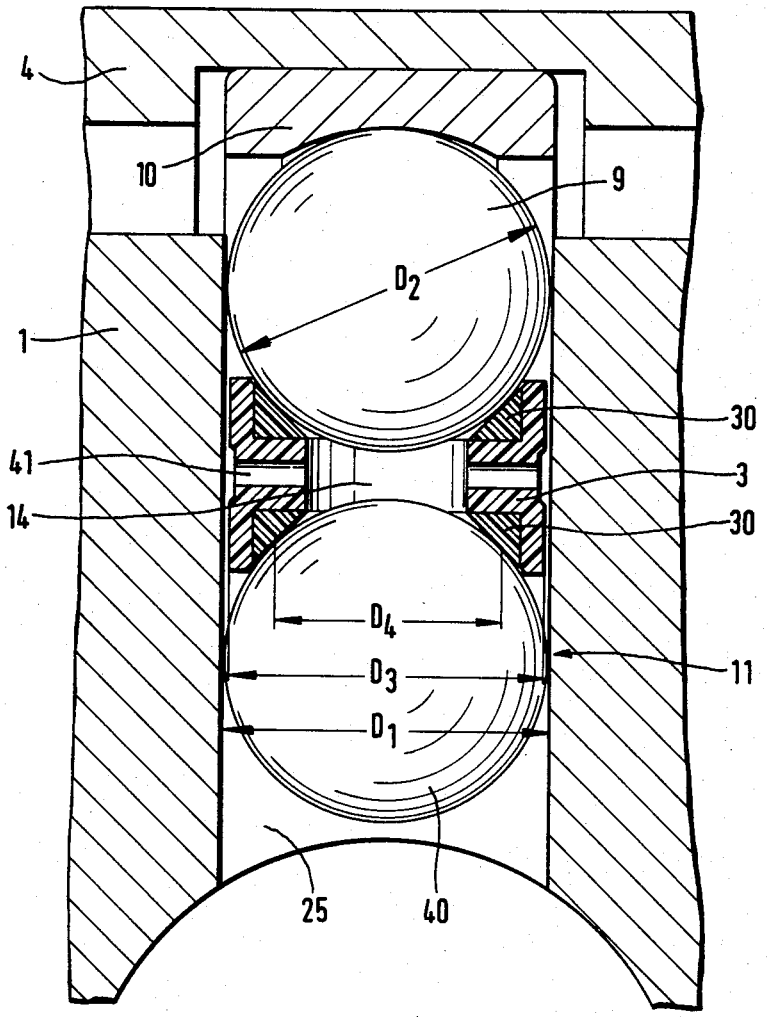
FIG. 3 is an enlarged cross sectional view of a detail of the pump of FIGS. 1 and 2.

The radial bore of rotor 1 houses spherical piston 11 which is shown in FIG. 3 on an enlarged scale.

Spherical piston 11 comprises an outer ball 9, an axially symmetric sleeve 3 including a central axial passageway 14 and an inner ball 40. Balls 9 and 40 are of like diameter. Sleeve 3 is constructed as a turned piece and has a cylindrical outer periphery which extends over almost the entire axial length of the sleeve. Central axial passageway 14 is connected with the outer periphery of sleeve 3 through a radial bore 41. The ends of sleeve 3 are recessed.

Sliding members 30 are integrated into the recessed area of the ends of sleeve 3. Each sliding member 30 has the shape of a ring whose cross-sectional surface is a right-angled triangle. Sliding member 30 is connected in a sealed manner to the sleeve 3 and is made of a sound-damping material having a low friction value, for instance, polytetraflourethylene.

When the arrangement is assembled, sliding members 30 will touch balls 9 and 40 substantially on a circle having the diameter $D_4$ on the hypotenuse side of sliding member 30.

The outer diameter $D_3$ of cylindrical sleeve 3 may be manufactured in an easy fashion allowing minor tolerances. The outer diameter $D_3$ is chosen so as to enable axial displacement of sleeve 3 in the rotor bore having the inner diameter $D_1$ under any operating conditions.

In the embodiment, the diameter $D_2$ of the two balls 9 and 40 corresponds substantially to the outer diameter $D_3$ of sleeve 3. Since the major part of balls 9 and 40 is placed inside the rotor bore, there will be formed seals between rotor 1 and balls 9 and 40 adjacent a great circle of each ball 9 and 40. When the spherical piston pump is in operation, pressure chamber 25 is subjected to hydraulic pressure which urges ball 40, sleeve 3 and ball 9 radially outwardly against outer cam ring 10. Since balls 9 and 40 are seated precisely in the rotor bore, a loss in pressure substantially alike will occur at each ball so that each ball is loaded with only half the working pressure. Upon rotation of rotor 1, the centrifugal force of ball 40 assists the sealing force between sliding member 30 and balls 9 and 40. In this arrangement, outer ball 9 rolls on cam ring 10, while it is in sliding engagement with sliding member 30. Friction losses are low, since sliding member 30 is composed of a low-friction material.

Compared to a spherical piston pump in which the piston comprises one single ball only, the inventive construction permits at high pressures and/or low viscosity of the operating medium a better sealing to be accomplished owing to a greater contacting length between components and, thus, an improvement of the volumetric efficiency and an increase in delivery. In addition, as a result of the greater centrifugal force of the entire arrangement, outer ball 9 will be urged against cam ring 10 with greater force, whereby the rolling of ball 9 on cam ring 10 is ensured to a greater extent.

While we have described above the principles of our invention in connection with specific apparatus, it is to be clearly understood that this description is made only by way of example and not as a limitation to the scope of our invention as set forth in the objects thereof and in the accompanying claims.

We claim:

1. A radial piston pump comprising an outer stator, an inner rotor rotatable on a control pintle having supply and discharge channels, said rotor including a radial bore in which a piston is slidable, said piston including a first ball disposed to roll on a cam surface associated with said stator, said piston further including a second ball and a sleeve therebetween with said sleeve spacing said second ball from said first ball with an axial passageway through said sleeve, said sleeve further including a first inclined wall in contact with said first ball and a second inclined wall in contact with said ball, the inward end of each of said inclined walls directed to said axial passageway, said first and second balls being of essentially the same diameter, and wherein said sleeve is of low friction material, wherein said sleeve is in operative sliding relation with both said balls but is not mechanically connected thereto and wherein there is a radial bore through said sleeve connecting said axial passageway with the sleeve outer periphery.

2. A spherical piston pump comprising:

an outer stator;

an inner rotor rotatable on a control pintle having supply and discharge channels;

at least one spherical piston including a first ball disposed to roll on a cam surface of a selected one of said stator and an outer cam ring; and a piston element slidable in a radial bore of said rotor, said first ball and said piston element being in a cooperative relationship with each other and said first ball has the periphery thereof slidably guided in said radial bore;

said piston element comprising a second ball, an intermediate member disposed between said first and second balls in an operative relationship therewith, but not mechanically connected thereto;

said intermediate member comprising a sleeve whose end surfaces abutting said first and second balls have an identical configuration, wherein said sleeve has an outer diameter substantially corresponding to the diameter of at least said first ball, wherein said sleeve includes an axial passageway, and wherein said sleeve includes a bore extending from said passageway to the periphery thereof.

3. A pump according to claim 2, wherein said sleeve has an outer diameter substantially corresponding to the diameter of at least said first ball.

4. A spherical piston pump comprising:

an outer stator;

an inner rotor rotatable on a control pintle having supply and discharge channels;

at least one spherical piston including a first ball disposed to roll on a cam surface of a selected one of said stator and an outer cam ring; and a piston element slidable in a radial bore of said rotor, said first ball and said piston element being in a cooperative relationship with each other and said first ball has the periphery thereof slidably guided in said radial bore;

said piston element comprising a second ball and an intermediate member disposed between said first and second balls in an operative relationship therewith, but not mechanically connected thereto;

said intermediate member comprising a sleeve whose end surfaces abutting said first and second balls have an identical configuration, wherein said end surfaces of said sleeve are sliding surfaces made of a material having a low coefficient of friction, each of said sliding surfaces being provided by an annular sliding member integrated into an associated end of said sleeve, wherein each of said sliding members are formed by a sound-damping material, and wherein each of said sliding members has a right angle triangle cross section whose hypotenuse is in engagement with an associated one of said first and second balls.

5. A pump according to claim 4, wherein said sleeve has a cylindrical outer periphery extending over the entire length thereof.

6. A pump according to claim 5, wherein said sleeve has an outer diameter substantially corresponding to the diameter of at least said first ball.

7. A pump according to claim 6, wherein said sleeve includes an axial passageway.

8. A pump according to claim 7, wherein said sleeve includes a bore extending from said passageway to the periphery thereof.

9. A pump according to claim 8, wherein said first and second balls have the same diameter.

10. A pump according to claim 9, wherein said sleeve is made of sound-damping material.

* * * * *